US009404396B2

(12) United States Patent
Eppinger et al.

(10) Patent No.: US 9,404,396 B2
(45) Date of Patent: Aug. 2, 2016

(54) MOTOR VEHICLE VALVE TRAIN ADJUSTMENT DEVICE

(71) Applicants: Matthias Eppinger, Neuenhagen (DE); Kai Lehmann, Ludwigsfelde (DE); Marc Maronde, Berlin (DE); Bernd Neubauer, Schwieberdingen (DE); Tilmann Roemheld, Waiblingen (DE); Thomas Stolk, Kirchheim (DE); Alexander Von Gaisberg-Helfenberg, Beilstein (DE)

(72) Inventors: Matthias Eppinger, Neuenhagen (DE); Kai Lehmann, Ludwigsfelde (DE); Marc Maronde, Berlin (DE); Bernd Neubauer, Schwieberdingen (DE); Tilmann Roemheld, Waiblingen (DE); Thomas Stolk, Kirchheim (DE); Alexander Von Gaisberg-Helfenberg, Beilstein (DE)

(73) Assignee: DAIMER AG, Stuttgart (DE)

( * ) Notice: Subject to any disclaimer, the term of this patent is extended or adjusted under 35 U.S.C. 154(b) by 16 days.

(21) Appl. No.: 14/480,076

(22) Filed: Sep. 8, 2014

(65) Prior Publication Data

US 2015/0013628 A1 Jan. 15, 2015

Related U.S. Application Data

(63) Continuation-in-part of application No. PCT/EP2013/000231, filed on Jan. 25, 2013.

(30) Foreign Application Priority Data

Mar. 8, 2012 (DE) ..... 10 2012 004 419

(51) Int. Cl.

| | |
|---|---|
| ***F01L 1/34*** | (2006.01) |
| ***F01L 1/04*** | (2006.01) |
| ***F01L 13/00*** | (2006.01) |
| ***F01L 1/344*** | (2006.01) |

(52) U.S. Cl.
CPC . *F01L 1/04* (2013.01); *F01L 1/344* (2013.01); *F01L 13/0036* (2013.01)

(58) Field of Classification Search
CPC ..... F01L 1/04; F01L 1/344; F01L 13/0036
USPC ..... 123/90.16
See application file for complete search history.

(56) References Cited

U.S. PATENT DOCUMENTS 7,409,938 B2 8/2008 Dengler

FOREIGN PATENT DOCUMENTS

| | | |
|---|---|---|
| DE | 10 2007 010155 | 9/2008 |
| DE | 10 2008 029349 | 12/2008 |
| DE | 10 2008 029385 | 12/2009 |
| JP | 2002-106357 | 4/2002 |
| JP | 2009-228543 | 10/2009 |

*Primary Examiner* — Zelalem Eshete
(74) *Attorney, Agent, or Firm* — Klaus J. Bach

(57) ABSTRACT

In a motor vehicle valve train adjustment device comprising at least one camshaft with at least two axially displaceable cam elements wherein at least one cam element has a cam track with a valve lift and a cam track with zero valve lift for a deactivation of at least one cylinder, and at least one other cam element of the at least two axially displaceable cam elements has a cam track with a first valve lift and a cam track with a second valve lift by which a cylinder which remains fueled during a partial cylinder deactivation is adapted to the at least one cylinder deactivation by special valve lift characteristics.

8 Claims, 1 Drawing Sheet

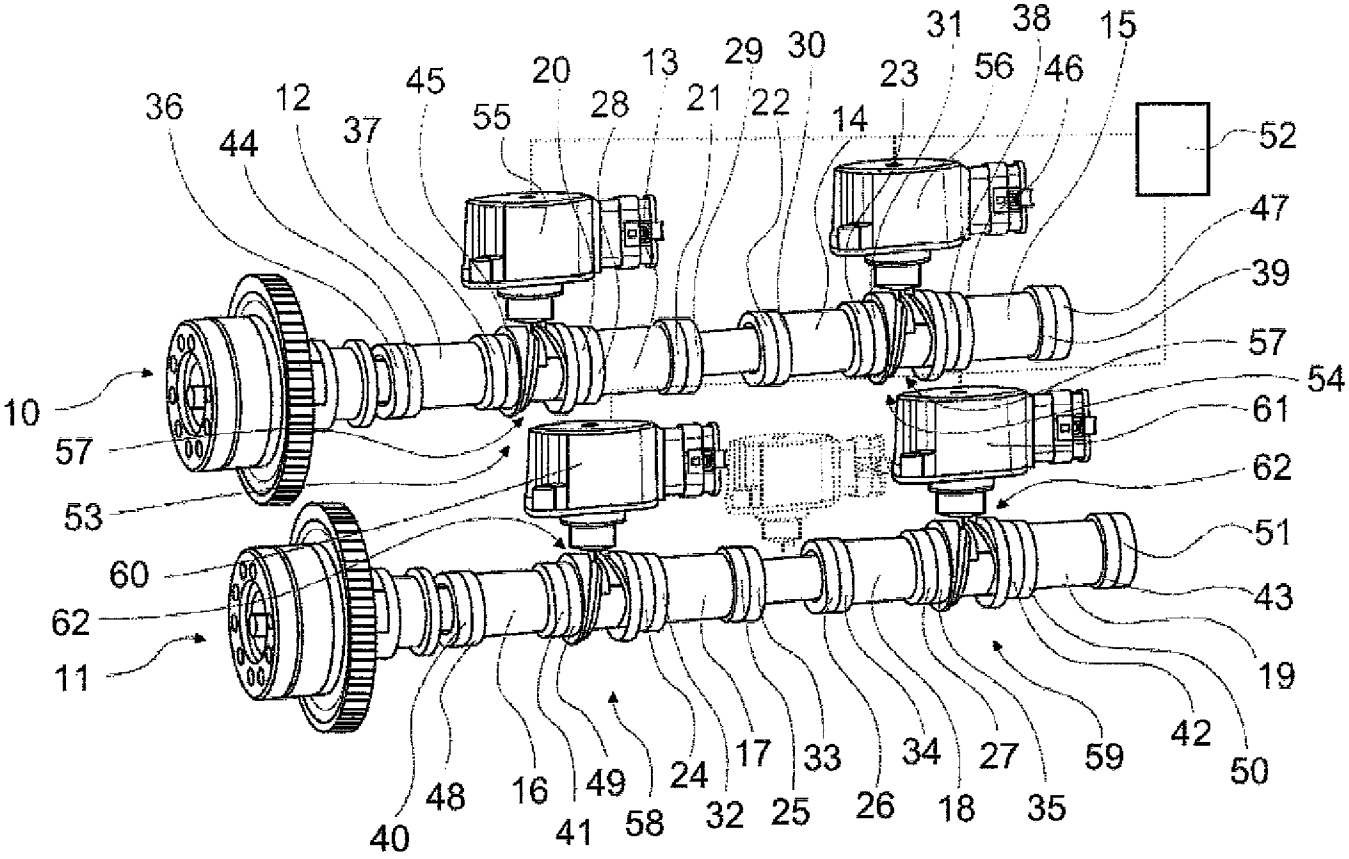
52
15
38
46
56
31
23
14
30
22
29
21
13
28
20
55
45
37
12
44
36
10
47
39
57
54
61
62
53
60
62
11
51
43
19
50
42
59
35
27
18
34
26
33
25
17
32
24
58
49
41
16
48
40

MOTOR VEHICLE VALVE TRAIN ADJUSTMENT DEVICE

This is a continuation-in-part application of international patent application PCT/EP2013/000231 filed Jan. 25, 2013 and claiming the priority of German patent application 10 2012 004 419.4 filed Mar. 18, 2012.

BACKGROUND OF THE INVENTION

The invention relates to a motor vehicle valve train adjustment device comprising a camshaft with at least two cam elements which are axially displaceably supported and of which at least one has a cam track with a predetermined cam lift and a cam track with zero lift for cylinder deactivation.

A motor vehicle valve train adjustment device is already known that has at least one camshaft that comprises at least two axially displaceably arranged cam elements, wherein at least one cam element of the at least two cam elements has a cam track with valve lift and a cam track with zero lift for cylinder deactivation.

It is the principal object of the present invention to provide a motor vehicle valve train adjustment device with a particularly advantageous cylinder deactivation system.

SUMMARY OF THE INVENTION

In a motor vehicle valve train adjustment device comprising at least one camshaft with at least two axially displaceable cam elements wherein at least one cam element has a cam track with a valve lift and a cam track with zero valve lift for a deactivation of at least one cylinder, and at least one other cam element of the at least two axially displaceable cam elements has a cam track with a first valve lift and a cam track with a second valve lift by which a cylinder which remains fueled during a partial cylinder deactivation is adapted to the at least one cylinder deactivation by special valve lift characteristics.

A "camshaft" is in particular to be understood to be a shaft that is provided for actuating a plurality of valves of an internal combustion engine and that has in each case at least one cam track for actuating a valve. In this respect it is conceivable that a camshaft is provided with intake cam elements for actuating intake valves and also exhaust cam elements for actuating exhaust valves.

A "cam element" is in particular to be understood as being an element that is arranged in a rotationally fixed manner on a camshaft, and for actuating a valve; it is provided for directly or indirectly acting on the corresponding valve with at least one lift. "Rotationally fixed" is in particular to be understood as a connection that transmits a torque and/or a rotational movement without changes. "Axial" is in particular to be understood as axial with regard to a main rotational axis of the cam shaft. "Axially displaceable" is in particular to be understood such that the cam element can be displaced on the camshaft parallel to the main rotational axis of the cam shaft between at least two switching positions. A "cam track" is in particular to be understood as a region of the cam element, which extends on the circumference of the cam element and which forms a valve actuation curve for valve actuation and/or defines the valve actuation. A "zero lift" is in particular to be understood such that a valve that is actuated with the zero lift has a valve lift that is constant during a full revolution of the cam element and preferably remains in its valve seat, so that a flow cross-section of the respective gas passage remains blocked throughout the entire time the zero lift is engaged. Here, the cam track with zero lift preferably remains without contact to the corresponding valve that is it does not touch it. While a cam element with zero lift is engaged, the corresponding valve remains non-actuated. A "valve lift" is in particular to be understood as a valve movement initiated by the cam tracks of the cam elements during which the valve preferably lifts off from its valve seat and thus opens a flow cross-section. "Cylinder deactivation" is in particular to be understood such that at least one cylinder of the internal combustion engine is deactivated during operation while at least one other cylinder of the internal combustion engine is still fueled. A "first valve lift and a second valve lift" is in particular to be understood as two valve lifts that differ from one another. Here, the valve lifts can differ in terms of theft lift height and/or their lift characteristics and/or can open and close the valves at different times.

Furthermore, it is proposed that the valve train adjustment device of the engine of the motor vehicle has a control and/or feedback control unit for the purpose of operating, in a deactivating operating state, the at least one cam element with zero lift and the at least one other cam element with a valve lift that is associated with relatively low engine power output needs. In this way, the motor vehicle valve train adjustment can be operated in particular during cylinder deactivation in a particularly advantageous manner. A "control and/or feedback control unit" is in particular to be understood as being a unit that has at least one control device. A "control device" is in particular to be understood as being a unit comprising a processor unit and a storage unit as well as an operating program that is stored in the storage unit. The control and/or feedback control unit principally can comprise a plurality of interconnected control devices which are preferably provided for communicating with each other via a bus system such as, in particular, a CAN bus system. "Provided" is in particular to be understood as specifically programmed, designed and/or equipped. "Deactivating operating state" is in particular to be understood as an operating state in which at least one cylinder is deactivated. "Operating a cam element with zero lift" is in particular to be understood to mean that the cam element with the cam element of the cam track that has the zero lift is engaged with the corresponding valve.

In addition, it is proposed that the motor vehicle valve train adjustment device has at least one exhaust camshaft that comprises at least two cam elements arranged in an axially displaceable manner, wherein at least one cam element of the at least two cam elements has a cam track with valve lift and a cam track with zero lift for cylinder deactivation. As a result, cylinder deactivation can be carried out in a particularly advantageous manner.

Moreover, it is proposed that the at least one other cam element of the at least two cam elements of the exhaust camshaft has a cam track with a first valve lift and a cam track with a second valve lift. In this way, the at least one other cam element that is associated with a cylinder that is still operative during cylinder deactivation in the partial cylinder deactivating engine operating state in a particularly advantageous manner.

Furthermore, it is proposed that the motor vehicle valve train adjustment device has a control and/or feedback control unit that is provided so as to switch, in at least one operating state, all cams of the intake camshaft, and to switch only cam elements to be deactivated of the exhaust camshaft. In this way, the cam elements for cylinder deactivation can be switched in a particularly simple manner.

A "cam element to be deactivated" is in particular to be understood as a cam element that has a cam track with zero lift for cylinder deactivation, and in particular for cylinder deactivation, it is switched into a switching position in which the cam track having the zero lift is engaged with the corresponding valve.

It is further proposed that the control and/or feedback control unit that is adapted to switch, in at least one operating state, all cam elements of the camshaft designed as an intake camshaft and of the camshaft designed as an exhaust camshaft. In this way, in particular the cam elements of the exhaust camshaft can be switched in a particularly advantageous manner for cylinder deactivation.

Furthermore, it is proposed that the control unit is adapted to switch, in at least one operating state, at least one cam element of the exhaust camshaft to a zero lift, and at least one cam element of the exhaust camshaft to one of the valve lifts that is associated with lower power. In this way, the internal combustion engine can be operated during cylinder deactivation in a particularly advantageous and efficient manner.

The invention will become more readily apparent from the following description thereof with reference to the accompanying drawing. In the drawing, an exemplary embodiment of the invention is illustrated. The drawing, the description and the claims include a multiplicity of features in combination. The person skilled in the art will also advantageously view the features individually and combine them into further suitable combinations.

BRIEF DESCRIPTION OF THE DRAWINGS

FIG. 1 shows an exemplary embodiment of a motor vehicle valve train adjustment device. The vehicle valve train adjustment device is part of an internal combustion engine for a motor vehicle, which is not illustrated in greater detail. The internal combustion engine is a four cylinder engine of a motor vehicle that is not illustrated. It is principally also conceivable that the internal combustion engine has a different number of cylinders as it may appear to be practical to the person skilled in the art. For each cylinder, the internal combustion engine has two exhaust valves which are not shown. It is principally also conceivable that the internal combustion engine has for each cylinder only one intake valve and one exhaust valve, or a different number of intake and/or exhaust valves as it appears to be practicable to the person skilled in the art. The motor vehicle valve train adjustment device has a camshaft 10 in the form of an intake camshaft that is provided for actuating the intake valves and an exhaust camshaft 11 actuating the exhaust valves. The camshafts 10, 11 are rotatably mounted in a cylinder head of the internal combustion engine.

The intake camshaft 10 comprises four cam elements 12, 13, 14, 15 which are arranged axially displaceable. The cam elements 12, 13, 14, 15 are connected to the intake camshaft 10 in a rotationally fixed manner via a positive-locking fit, which is not illustrated in greater detail. In an axial direction that runs parallel to a rotational axis of the camshaft 10, the cam elements 12, 13, 14, 15 can be moved between two switching positions. It is principally also conceivable that the cam elements 12, 13, 14, 15 are connected to the camshaft 10 in a different manner that appears to be practicable to the person skilled in the art. The first cam element 12 is associated with the first cylinder and with the corresponding intake valves. The second cam element 13 is associated with the second cylinder and the corresponding intake valves. The third tarn element 14 is associated with the third cylinder and with the corresponding intake valves. The fourth cam element 15 is associated with the fourth cylinder and with the corresponding intake valves.

The axially displaceable cam elements 12, 13, 14, 15 are provided for actuating and adjusting a valve lift of in each case two intake valves of a cylinder. For this purpose, the cam elements 12, 13, 14, 15 have in each case two cam tracks 20, 21, 22, 23, 28, 29, 30, 31, 36, 37, 38, 39, 44, 45, 46, 47 for in each case one valve intake valve. Each of the cam elements 12, 13, 14, 15 has two first cam tracks 20, 21, 22, 23, 36, 37, 38, 39 and two second cam tracks 28, 29, 30, 31, 44, 45, 46, 47. In each case, one first cam track 20, 21, 22, 23, 36, 37, 38, 39 and a second cam track 28, 29, 30, 31, 44, 45, 46, 47 are associated with the same inlet valve of a cylinder and have different valve lifts and/or lift characteristics, The first cam tracks 20, 21, 22, 23, 36, 37, 38, 39 and the second cam tracks 28, 29, 30, 31, 44, 45, 46, 47 which are each associated with the same intake valve of the respective cylinder are in each case arranged adjacently on the respective cam element 12, 13, 14, 15, The first cam tracks 20, 21 22, 23, 36, 37, 38, 39 of all cam elements 12, 13, 14, 15 of the intake camshaft 10 have a first valve lift. Here, the first valve lifts that are initiated by the first cam tracks 20, 21, 22, 23, 36, 37, 38, 39 of the cam elements 12, 13, 14, 15 are identical. The first valve lifts that are initiated by the first cam tracks 20, 21, 22, 23, 36, 37, 38, 39 of the cam elements 12, 13, 14, 15 differ from one another only in terms of a chronological sequence. The second cam tracks 44, 45, 46, 47 of the first cam element 12 and the fourth cam element 15 have a second valve lift. Here, the second valve lifts that are initiated by the second cam tracks 44, 45, 46, 47 of the first cam element 12 and the fourth cam element 15 are formed identically. The second valve lifts that are initiated by the second cam tracks 44, 45, 46, 47 of the first cam elements 12 and the fourth cam element 15 differ from one another only in terms of a chronological sequence. The second cam tracks 28, 29, 30, 31 of the second cam element 13 and the third cam element 14 have a zero lift for cylinder deactivation. During a full revolution of the cam elements 13, 14, no actuation is caused by the second cam tracks 28, 29, 30, 31 of the second and third cam elements 13, 14. The second cam tracks 28, 29, 30, 31 of the second and third cam elements 13, 14 have a maximum distance from the main rotational axis of the camshaft 10 that is less than that of the first cam tracks 20, 21, 22, 23, 36, 37, 38, 39 The second cam tracks 28, 29, 30, 31 of the second and third cam elements 13, 14 are without contact to the associated intake valve during a full revolution of the corresponding cam element 13, 14. The second cam tracks 28, 29, 30, 31 of the second and third cam element 13, 14 do not actuate the intake valves so that the respective cylinder is not filled with a fuel/air mixture and thus cannot be ignited. While the second cam tracks 28, 29, 30, 31 of the second and third cam element 13, 14 are engaged, the corresponding cylinder is deactivated and does not generate a drive torque. It is principally also conceivable that the second cam tracks 28, 29, 30, 31 of the second and third cam elements 13, 14 touch the corresponding intake valve, but do not lift it out of its valve seat.

In a first switching position of the cam elements 12, 13, 14, 15, the first cam tracks 20, 21, 22, 23, 36, 37, 38, 39 actuate the corresponding intake valves. In a second switching position of the cam elements, the second cam tracks 44, 45, 46, 47 of the first cam element 12 and the fourth cam element 15 actuate the corresponding inlet valve with the second valve lift, while the second cam element 13 and the third cam element 14 have the cam tracks 28, 29, 30, 31 with zero lift in engagement, and the corresponding intake valves therefore remain non-actuated. In order to adjust a valve lift of the intake valves of a cylinder, the corresponding cam element 12, 13, 14, 15 are switched from one switching position into the other switching position.

In each case two adjacent cam elements 12, 13, 14, 15 of an intake camshaft 10, are designed to be switched together as a cam element group 53, 54. The first cam elements 12 that is associated with the first cylinder, and the second cam element 13 that is associated with the second cylinder, form the first cam element group 53 to be switched together. The third cam element 14 that is associated with the third cylinder and the fourth cam element 15 that is associated with the fourth cylinder, form the second cam element group 54 that is to be switched together. The cam elements 12, 13, 14, 15 of one of the cam element groups 53, 54 are each formed separately from one another as separate individual components. The cam elements 12, 13, 14, 15 of a cam element group 53, 54 are in each case switched together during a switching process. The two cam element groups 53, 54 can be switched independently of one another. The first cam element group 53 that is formed by the first cam element 12 and the second cam element 13, and the second cam element group 54 that is formed by the third cam element 14 and the fourth carry element 15, can be switched independently from one another.

The motor vehicle valve train adjustment device comprises two actuator devices 55, 56 which are associated with the camshaft intake camshaft 10. In each case one actuator device 55, 56 is associated with one of the cam element groups 53, 54 of the intake camshaft 10. The actuator devices 55, 56 interconnect the cam elements 12, 13, 14, 15 of their associated cam element group 53, 54 during a switching process. The first actuator device 55 is associated with the first cam element group 53 and is provided for switching the first cam element 12 and the second cam element 13. The second actuator device 56 is associated with the second cam element group 54 and is provided for switching the third cam element 14 and the fourth cam element 15.

The first actuator device 55 and the second actuator device 56 are structurally identical. The actuator devices 55, 56 each have a schematically illustrated guide path 57. The actuator devices 55, 56 comprise an actuator each with a switching element in the form of a switching pin. During a switching process, the switching elements engage into the corresponding guide path 57 of the actuator device 55, 56, The actuator devices 55, 56 each switch in a first instance a cam element 12, 14 from one switching position into the other switching position and subsequently switch the other cam element 13, 15 of the corresponding cam element group 53, 54 from one switching position into the other switching position.

The camshaft 11 which is an exhaust camshaft likewise comprises four cam elements 16, 17, 18, 19 that are arranged to be axially displaceable. The cam elements 16, 17 18, 19 are connected to the exhaust camshaft 11 in a rotationally fixed manner via a positive-locking fit, which is not illustrated in greater detail. In the axial direction of the camshaft 11, the cam elements 16, 17, 18, 19 can be moved between two switching positions. It is principally also conceivable that the cam elements 16, 17, 18, 19 are connected to the camshaft 11 in a different manner that appears to be practicable to the person skilled in the art. The first cam element 16 is associated with the first cylinder and with the corresponding exhaust valves. The second cam element 17 is associated with the second cylinder and with the corresponding exhaust valves. The third cam element 18 is associated with the third cylinder and with the corresponding exhaust valves. The fourth cam element 19 is associated with the fourth cylinder and with the corresponding exhaust valves.

The axially displaceable cam elements 16, 17, 18, 19 are provided for actuating and adjusting a valve lift of in each case two exhaust valves of a cylinder. For this purpose, the cam elements 16, 17, 18, 19 have in each case two cam tracks 24, 25, 26, 27, 32, 33, 34, 35, 40, 41, 42, 43, 48, 49, 50, 51 for in each case one exhaust valve. Each of the cam elements 16, 17, 18, 19 has two first cam tracks 24, 25, 26, 27, 40, 41, 42, 43 and two second cam tracks 32, 33, 34, 35, 48, 49, 50, 51. In each case one first cam track 24, 25, 26, 27, 40, 41, 42, 43 and a second cam track 32, 33, 34, 35, 48, 49, 50, 51 which are associated with the same exhaust valve of a cylinder have different valve lifts and/or lift characteristics. The first cam tracks 24, 25, 26, 27, 40, 41, 42, 43 and the second cam tracks 32, 33, 34, 35, 48, 49, 50, 51 which are each associated with the same valve of the respective cylinder are in each case arranged adjacently on the respective cam element 16, 17, 18, 19. The first cam tracks of all cam elements 24, 25 26, 27, 40, 41, 42, 43 have a first valve lift. Here, the first valve lifts that are initiated by the first cam tracks 24, 25, 26, 27, 40, 41, 42, 43 of the cam elements 16, 17, 18, 19 are formed identically. The first valve lifts that are initiated by the first cam tracks 24, 25, 26, 27, 40, 41, 42, 43 of the cam elements 16, 17, 18, 19 differ from one another only in terms of a chronological sequence of activation. The second cam tracks 48, 49, 50, 51 of the first cam element 16 and the fourth cam element 19 have a second valve lift. Here, the second valve lifts that are initiated by the second cam tracks 48, 49, 50, 51 of the first cam element 16 and the fourth cam element 19 are formed identically. The second valve lifts that are initiated by the second cam tracks 48, 49, 50, 51 of the first cam element 16 and the fourth cam element 19 differ from one another only in terms of a chronological sequence of activation. The second cam tracks 32, 33, 34, 35 of the second cam element 17 and the third cam element 18 have a zero lift for cylinder deactivation. During a full revolution of the cam elements 17, 18, no valve actuation is caused by the second cam tracks 32, 33, 34, 35 of the second cam element 17 and the third cam elements 18. The second cam tracks 32, 33, 34, 35 of the second and third cam elements 17, 18 have a maximum distance from the main rotational axis of the camshaft 11 that is less than that of the first cam tracks 24, 25, 26, 27, 40, 41, 42, 43. The second cam tracks 32, 33, 34, 35 of the second and third cam elements 17, 18 are without contact to the associated exhaust valve, during a full revolution of the corresponding cam element 17, 18. The second cam tracks 32, 33, 34, 35 of the second and third cam elements 17, 18 do not actuate the valves designed as exhaust valves so that no gas can escape from the corresponding cylinder through the exhaust valves. While the second cam tracks 32, 33, 34, 35 of the second and third cam elements 17, 18 are engaged, the corresponding cylinder are deactivated and do not generate a drive torque. It is principally also conceivable that the second cam tracks 32, 33, 34, 35 of the second and third cam elements 17, 18 touch the corresponding exhaust valve, but do not lift it out of its valve seat.

In a first switching position of the cam elements 16, 17, 18, 19, the first cam tracks 24, 25, 26, 27, 40, 41, 42, 43 of the corresponding cam elements 16, 17 18, 19 actuate the corresponding exhaust valves. In a second switching position of the cam elements 16, 17, 18, 19, the second cam tracks 48, 49, 50, 51 of the first cam element 16 and the fourth cam element 19 actuate the corresponding exhaust valve with the second valve lift, while the second cam element 17 and the third cam element 18 have the cam tracks 32, 33, 34, 35 with zero lift in engagement, and the corresponding exhaust valves therefore remain non-actuated. In order to adjust a valve lift of the exhaust valves of a cylinder, the corresponding cam element 16, 17, 18, 19 is switched from one switching position into the other switching position.

In each case two of the cam elements 16, 17, 18, 19 of the exhaust camshaft 11, which cam elements are arranged adjacently, are switched together as a cam element group 58, 59.

The first cam element 16 that is associated with the first cylinder and the second cam element 17 that is associated with the second cylinder form the first cam element group 58 to be switched together. The third cam element 18 that is associated with the third cylinder and the fourth cam element 19 that is associated with the fourth cylinder form the second cam element group 59 that is to be switched together. The cam elements 16, 17, 18, 19 of one of the cam element groups 58, 59 of the exhaust camshaft 11 are each formed separately from one another as separate individual components. The cam elements 16, 17, 18, 19 of a cam element group 58, 59 of the exhaust camshaft 11 are in each case switched together during a switching process. The two cam element groups 58, 59 of the exhaust camshaft 11 can be switched independently of one another. The first cam element group 58 that is formed by the first cam element 16 and the second cam element 17, and the second cam element group 59 that is formed by the third cam element 18 and the fourth cam element 19, can be switched independently from one another.

The motor vehicle valve train adjustment device comprises two actuator devices 60, 61 which are associated with the exhaust camshaft 11. In each case one actuator device 60, 61 is associated with one of the cam element groups 58, 59 of the exhaust camshaft 11. The actuator devices 60, 61 interconnect the cam elements 16, 17, 18, 19 of their associated cam element group 58, 59 during a switching process. The first actuator device 60 is associated with the first cam element group 58 for switching the first cam element 16 and the second cam element 17. The second actuator device 61 is associated with the second cam element group 59 for switching the third cam element 18 and the fourth cam element 19.

The first actuator device 60 and the second actuator device 61 of the exhaust camshaft 11 are structurally identical to the actuator devices 55, 56 of the intake camshaft 10. The actuator devices 60, 61 each have a schematically illustrated guide path 62. The actuator devices 60, 61 comprise an actuator with in each case a switching element in the form of a switching pin. During a switching process, the switching elements engage into the corresponding guide path 62 of the actuator device 60, 61. The actuator devices 60, 61 switch in a first instance a cam element 16, 18 from one switching position into the other switching position and subsequently switch the other cam element 17, 19 of the corresponding cam element group 58, 59 from one switching position into the other switching position.

The motor vehicle valve train adjustment device comprises a control and feedback control unit 52. for switching the actuator devices 55, 56 associated with the intake camshaft 70, and also for switching the actuator devices 60, 61 associated with the exhaust camshaft 11. By activation of the control and feedback control unit 52, the cam elements 12, 13, 14, 15 of the intake camshaft 10 and the cam elements 16, 17, 18, 19 of the exhaust camshaft 11 can be switched.

The control and feedback control unit 52 has a deactivating operating state for cylinder deactivation. In the deactivating operating state, the control and feedback control unit 52 is provided for operating the cam elements 13, 14 of the intake camshaft 10, which cam elements have a cam track 28, 29, 30 31 with zero lift and for operating the other cam elements 12, 15 of the intake camshaft 11 with the second valve lift. Here, the second valve lift, with which the cam elements 12, 15 are operated, is associated with lower power. Power that can be provided by the corresponding cylinder when the corresponding cam element 12 is operated with the second valve lift is lower than the power that can be provided by the cylinder when the corresponding cam element 12, 15 is operated with the first valve lift. For this purpose, starting from a normal operating state in which all cam elements 12, 13, 14, 15 of the intake camshaft 10 are engaged by the first cam track 20, 21, 22, 23, 36, 37, 38, 39 and thus are operated with the first valve lift, the control and feedback control unit 52, for switching the deactivating operating state by means of the actuator devices 55, 56, switches all cam elements 12, 13, 14, 15 of the intake camshaft 10 from the first switching position into the second switching position in which the cam elements 12, 13, 14, 15 each are displaced and the second cam tracks 28, 29, 30, 31, 44, 45, 46, 47 are activated.

For switching into the deactivating operating state, the control and feedback control unit 52 also switches all cam elements 16, 17, 18, 19. The control and feedback control unit is provided here for switching the second and the third cam elements 17, 18 of the exhaust camshaft 11 to a zero lift, and for switching the first and the fourth cam elements 16, 19 of the exhaust camshaft 11 to the second valve lift that is associated with lower power. In doing so, the control and feedback control unit 52 switches all cam elements 16, 17, 18, 19 into the second switching position by means of the actuator devices 60, 61. In this way, the second cam element 17 and the third cam element 18 actuate the corresponding exhaust valves for zero lift, whereby the corresponding valves remain non-actuated. The first cam element 16 and the fourth cam element 19 actuate the corresponding exhaust valves so as to provide the second valve lift.

It is principally also conceivable that only the cam elements 17, 18 of the exhaust camshaft 11, which comprise the cam tracks 32, 33, 34, 35 with zero lift are designed to be switchable and are switched for cylinder deactivation. In this case it would be conceivable that the first cam element 16 and the fourth cam element 19 only comprise the first cam track 40, 41, 42, 43. In this case, as illustrated in FIG. 1 by dashed lines, only one actuator device would be needed which switches the second cam element 17 and the third cam element 18, which in this case would be combined into a cam element group, between the first switching position and the second switching position. For switching into the deactivating operating state, the control and feedback control unit 52 is provided in this case for switching only the cam elements 17, 18 of the exhaust camshaft 11, which cam elements have each a cam track with zero lift. For switching the deactivating operating state, the control and feedback control unit 52 switches in this case only the second cam element 17 and the third cam element 18 of the exhaust camshaft 11 from the first switching position into the second switching position. The first cam element 16 and the fourth cam element 19 of the exhaust camshaft 11 are not switched herein. Switching the cam elements 12, 13, 14, 15, of the intake camshaft 10 remains as described above. For switching the deactivating operating state, however, the control and feedback control unit 52 switches all cam elements 12, 13, 14, 15 of the intake camshaft 10 from the first switching position into the second switching position.

What is claimed is:

1. A motor vehicle valve train adjustment device comprising at least one camshaft (10) with first and second cam elements (12, 13, 14, 15) axially displaceably disposed thereon, the first cam elements (13, 14) having a cam track (20, 21, 22, 23) with a first valve lift and an adjacent cam track (28, 29, 30, 31) with zero cam lift for cylinder deactivation and the second cam elements (12, 15) having a cam track (36, 37, 38, 39) with the first valve lift and a cam track (44, 45, 46, 47) with a second valve lift designed for operation in connection with a cylinder deactivation by activation of the zero lift cams (28, 29, 30, 31) of the first cam elements (13, 14), and a control unit (52) for axially displacing the first cam elements (13, 14) between an all cylinder activation and a partial cylinder deactivation position, in which the zero lift cams are activated and the second cam element (12, 15) are moved to a position providing for the second valve lift associated with the partial cylinder inactivation providing for a continuing engine power generation by increased power output of the remaining active cylinders.

2. The motor vehicle valve train adjustment device according to claim 1, wherein the at least one camshaft (10) is an intake camshaft and an exhaust camshaft (11) is provided for operating exhaust valves.

3. The motor vehicle valve train adjustment device according to claim 2, wherein the exhaust camshaft (11) comprises at least two axially displaceably arranged cam elements (16, 17, 18, 19), wherein at least one cam element (17, 18) of the at least two cam elements (16, 17, 18, 19) has a cam track (24, 25, 26, 27) with valve lift and a cam track (32, 33, 34, 35) with zero lift for cylinder deactivation.

4. The motor vehicle valve train adjustment device according to claim 2, wherein the at least one other cam element (16, 19) of the at least two cam elements (16, 17, 18, 19) of the exhaust camshaft (11) has a cam track (40, 41, 42, 43) with a first valve lift and a cam track (48, 49, 50, 51) with a second valve lift.

5. The motor vehicle valve train adjustment device according to claim 4, wherein a control unit (52) is provided for switching, in at least one operating state, all cam elements (12, 13, 14, 15) of the intake camshaft (10) and for switching only cam elements (17, 18) to be deactivated of the exhaust camshaft.

6. The motor vehicle valve train adjustment device according to claim 3, wherein a control unit (52) is provided for switching, in at least one operating state, all cam elements (12, 13, 14, 15, 16, 17, 18, 19) of the intake camshaft (10) and of the exhaust camshaft (11).

7. The motor vehicle valve train adjustment according to claim 4, wherein a control unit (52) is provided for switching, in at least one operating state, at least one cam element (17, 18) of the exhaust camshaft (11) to zero lift and for switching at least one cam element (16, 19) of the an exhaust camshaft (11) to a valve lift that is associated with lower power.

8. An internal combustion engine comprising a motor vehicle valve train adjustment device according to claim 1.

* * * * *